US006935660B1

(12) United States Patent
Lemley et al.

(10) Patent No.: US 6,935,660 B1
(45) **Date of Patent: *Aug. 30, 2005**

(54) PREMIUM DOOR LOCKING SYSTEM

(75) Inventors: Russ Lemley, Chandler, AZ (US); Aric Clawson, Phoenix, AZ (US)

(73) Assignee: Mobile Mini, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/619,867

(22) Filed: Jul. 15, 2003

Related U.S. Application Data

(63) Continuation-in-part of application No. 09/955,341, filed on Sep. 12, 2001, now Pat. No. 6,592,155.

(51) Int. Cl.[7] ..... E05C 7/00
(52) U.S. Cl. ..... 292/36; 292/33
(58) Field of Search ..... 292/36, 41, 35, 292/33

(56) References Cited

U.S. PATENT DOCUMENTS 786,586 A * 4/1905 Moreland ..... 70/51
2,209,727 A * 7/1940 Gibson ..... 292/36
3,088,548 A * 5/1963 Behrens et al. ..... 187/331
4,046,410 A * 9/1977 Connell ..... 292/36
5,029,909 A * 7/1991 Bunger ..... 292/40
5,110,164 A * 5/1992 Whiteman et al. ..... 292/4

* cited by examiner

*Primary Examiner*—Gary Estremsky
(74) *Attorney, Agent, or Firm*—Frank J. McGue

(57) ABSTRACT

A locking system is described for use with a storage container. The locking system is integral with a door of the cargo storing container. The locking system comprises a housing mounted to and extending through a door with two rods extending from the housing. The rods have a locked position extending beyond the periphery of the door and an unlocked position not extending beyond the periphery of the door. Each of the two rods has at least one tapered edge on the inside edge extending beyond the periphery of the door in the locked position. Two rod receivers, each rod receiver corresponding to one of the two rods, are adapted to receive the tapered edges of the two rods in the locked position. The tapered edges engage the two rod receivers thereby acting to seal the door tightly in the locked position. A handle recessed behind the housing rotatably engages a cam plate contained within the housing. The cam plate is operatively engaged with the two rods with the handle rotating the cam plate to move the rods from one of the locked position and the unlocked position to the other of the locked position and the unlocked position.

8 Claims, 11 Drawing Sheets

PREMIUM DOOR LOCKING SYSTEM

RELATED APPLICATION

The present application is a continuation in part of co-pending application Ser. No. 09/955,341 filed Sep. 12, 2001, now U.S. Pat. No. 6,592,155.

TECHNICAL FIELD

This invention relates to an locking system for containers, in particular, for storage containers.

BACKGROUND OF THE INVENTION

Although the prior art shows locking systems for containers, none are believed to illustrate the type of device disclosed and claimed.

Storage containers referred to in the present specification are generally large, walk in boxes similar in size to semi-trailer trucks. The containers can be stacked and shipped by rail and by ship easily. In addition, such containers are used as storage devices by end users.

With any such container, maintaining security for the contents is a prime concern. Because such containers are often left unattended, they become targets for thieves and other criminals. Thus, the manufacturers and users of such containers continue to seek and develop better security techniques while the criminal element continues to develop methods for attacking and circumventing those security measures.

In addition, some storage applications require a seal around the doors to prevent entry of water, insects, and other environmental elements. For example, paper and furniture storage is best served by a sealed container.

Various types of locking systems have been described in the prior art.

U.S. Pat. No. 5,029,909 entitled "Door Lock Assembly" which issued on Jul. 9, 1991 owned by assignee of the present invention discloses a protective device for locking the doors of a storage container using a two bar configuration.

U.S. Pat. No. 5,261,258 entitled "Padlock Protector" which issued on Nov. 16, 1993 owned by assignee of the present invention discloses a security device which consists of an exterior mounted housing for a latch bar which defines a recess. The recess provides access to an aperture in the bar by a circular shackle of a disk shaped padlock. This device operates in much the same fashion as the present invention. However, it is also believed to be less effective because of its exterior mounting and structure allow some access to the locking mechanism and the shaft by drills and hammer devices.

U.S. Pat. No. 5,509,700 entitled "Latch and Lock for Trailer Doors" which issued on Apr. 23, 1996 to Kennedy, Jr., and owned by assignee of the present invention, discloses a concealed latch with an arm attached to a pivot operatively connected to a pair of locking bars.

However, the devices of the prior art described above are not completely satisfactory. For example, such devices often require a great deal of effort to close and latch. In one system, the user is required to bend over and operate the lever system in a particular sequence. In addition, the devices are often difficult to operate if the container is not level.

Thus, there is a need for a door locking system which is simple to operate and provides the necessary sealing action simply by operating one lever in one action. The system should provide ease of operation even when the doors are out of alignment or the container is not level. The present invention meets this need.

None of the known prior art disclose the device set forth herein.

SUMMARY OF THE INVENTION

It is an object of this invention to provide an improved locking system for storage containers which provides additional security therefore.

It is a further object of this invention to provide an improved locking system for storage containers which provides a tight seal against the elements therefore.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawings in which.

DESCRIPTION OF THE PREFERRED EMBODIMENT

Figure 1:
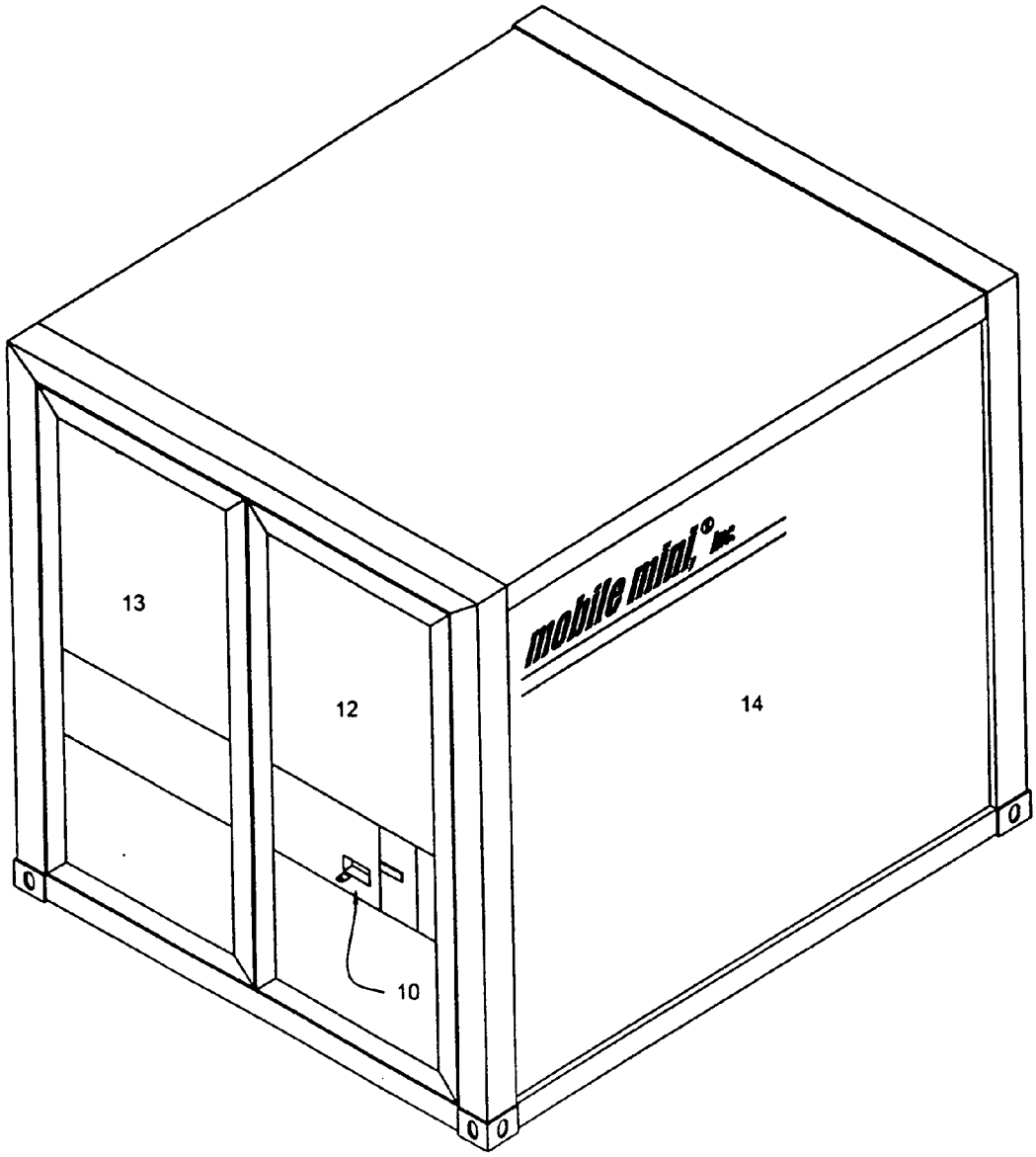
FIG. 1 is a perspective front and side view of a storage container embodying the present invention.
Figure 2:
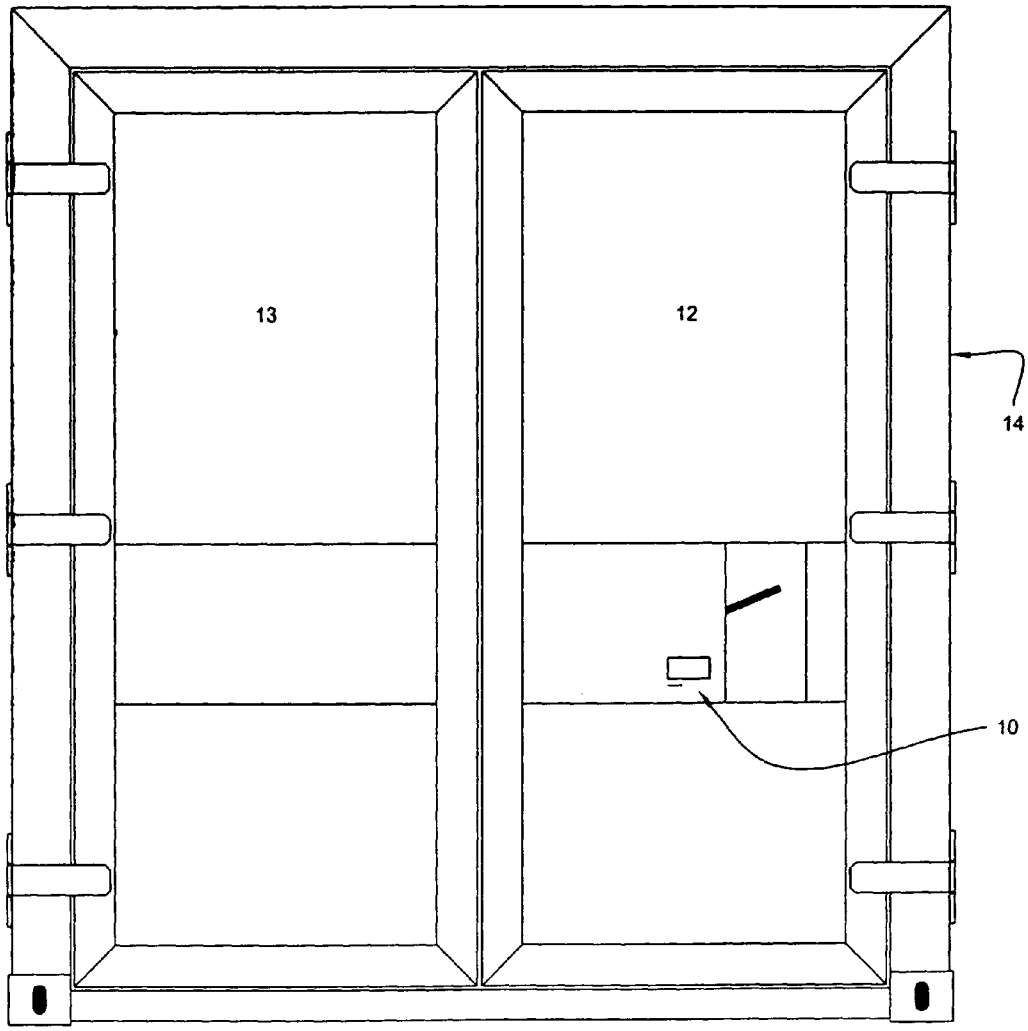
FIG. 2 is a front of the embodiment of FIG. 1.

Referring more particularly to the drawings by characters of reference, FIGS. 1–9 disclose one embodiment of an improved locking system 10 mounted to one door 12 of a cargo storing container 14 or other door assembly and the floor thereof. Door 12 and its companion door 13 overlap and open outwardly with door 13 being closed first and door 12 being closed thereafter. The operation of such doors 12 and 13 are well known to those of ordinary skill in the art and will not be further discussed herein.

Figure 3:
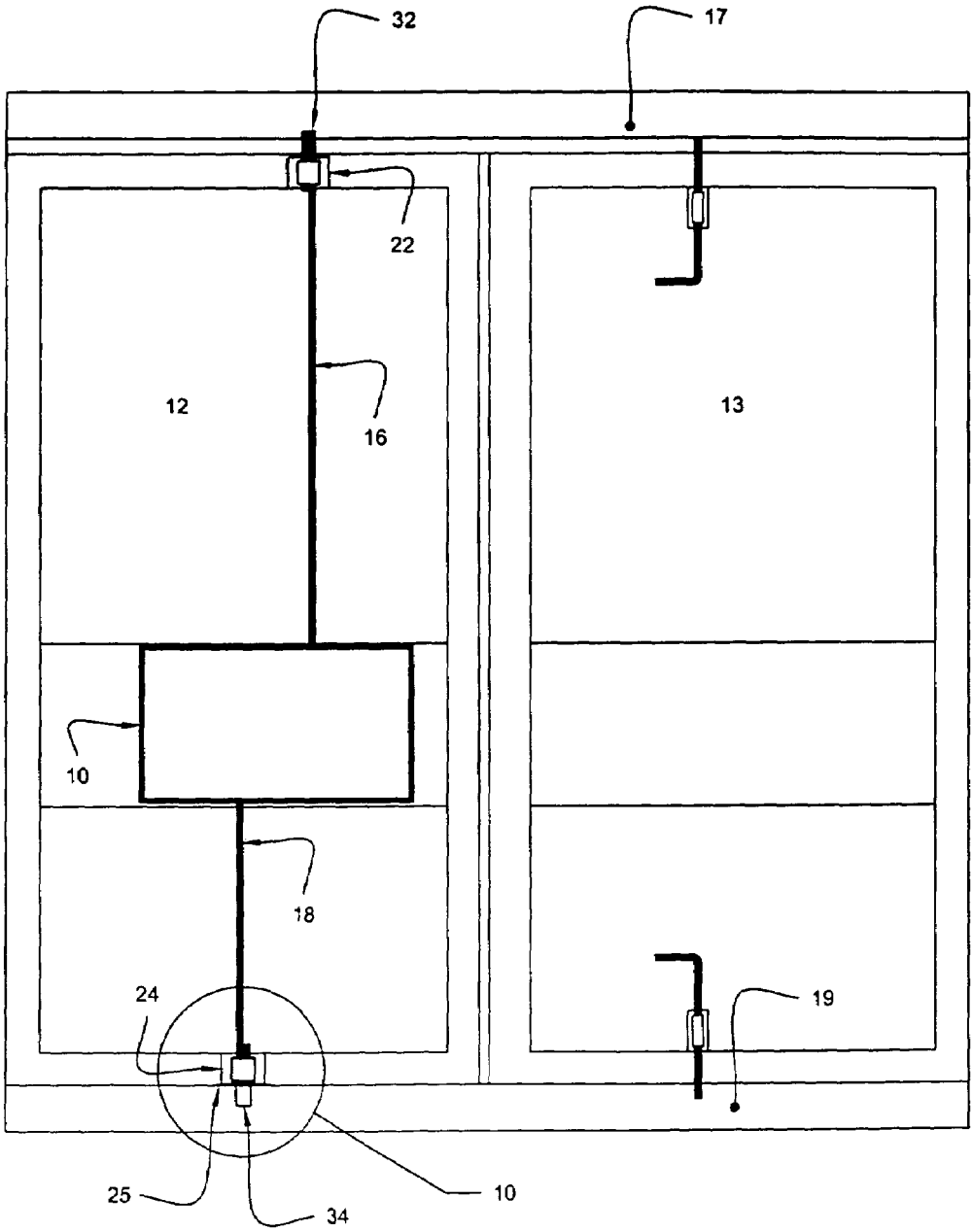
FIG. 3 is a rear view of the embodiment of FIG. 1 in a locked position.
Figure 4:
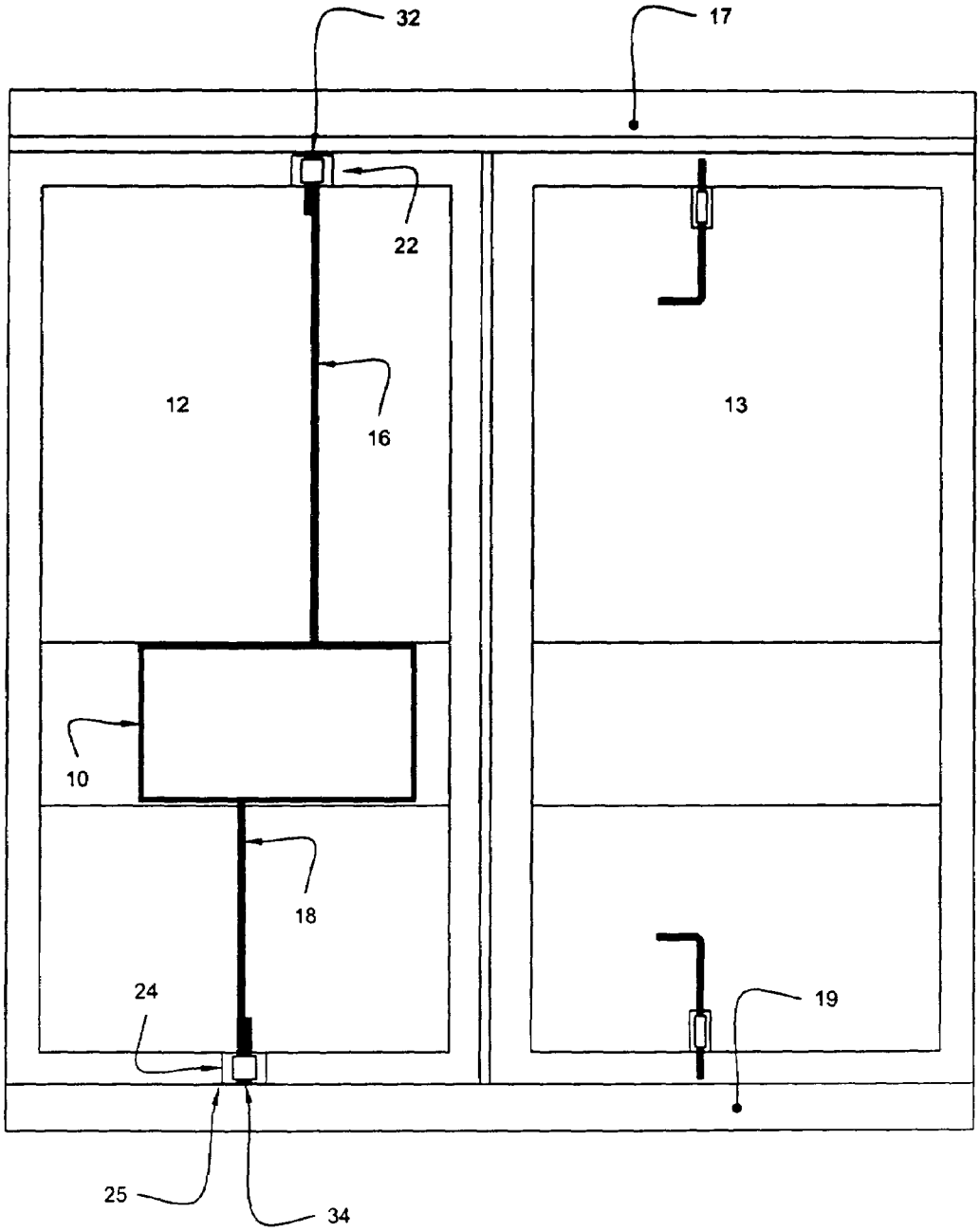
FIG. 4 is a rear view of the embodiment of FIG. 1 in an unlocked position.

As best seen in FIGS. 3 and 4, locking system 10 operatively engages a top rod 16 extending upwardly therefrom and a bottom rod 18 extending downwardly therefrom. Rods 16 and 18 are mounted on the interior side of door 12. Rods 16 and 18 have a locked position illustrated in FIG. 3 wherein the rods extend just beyond the periphery of door 12 to engage a ceiling 17 and a floor 19, respectively, and an unlocked position illustrated in FIG. 4 wherein the rods do not extend beyond the periphery of door 12. Locking system 10 slides rods 16 and 18 between the two positions as desired. To open system 10, both rods 16 and 18 must be disengaged.

To align rods 16 and 18, a top rod guide 22 and a bottom rod guide 24 are provided mounted on door 12 proximate to the periphery thereof. Rods 16 and 18 preferably engage a ceiling lock rod guide 22 and a floor lock rod guide 24.

To engage rod 18, a bottom rod receiver 25 is provided mounted to floor 19 proximate to bottom rod guide 24 whereby said bottom rod guide directs said rod 18 into said bottom rod receiver 25 in the locked position illustrated in FIG. 3.

Each rod 16 and 18 includes at least one tapered edge 32*b* and 34*b*, respectively, positioned on the inside edge of the rods and which facilitate alignment of each rod with a respective lock rod guide 22, 24. In the most preferred embodiment best illustrated in FIGS. 10 and 11, rods 16 and 18 have three tapered edges 32*a–c* and 34*a–c* which are positioned on the inside and lateral edges of the rods.

Figure 10:
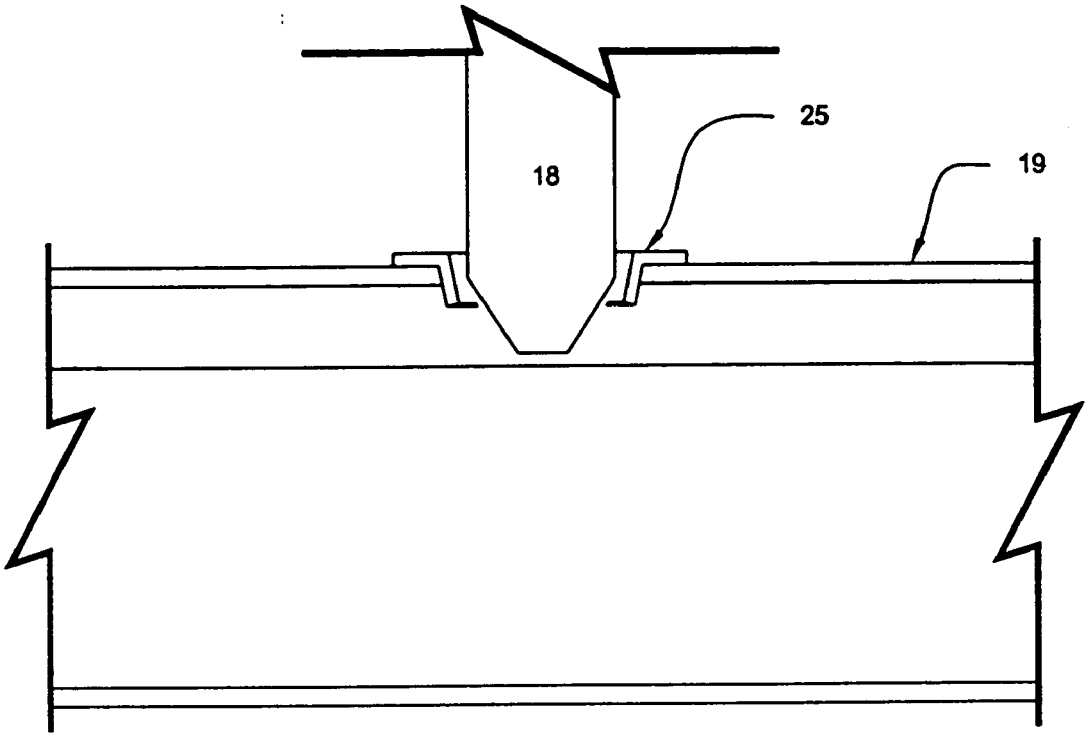
FIG. 10 is a close up view of the circled area 10 in FIG. 3.
Figure 11:
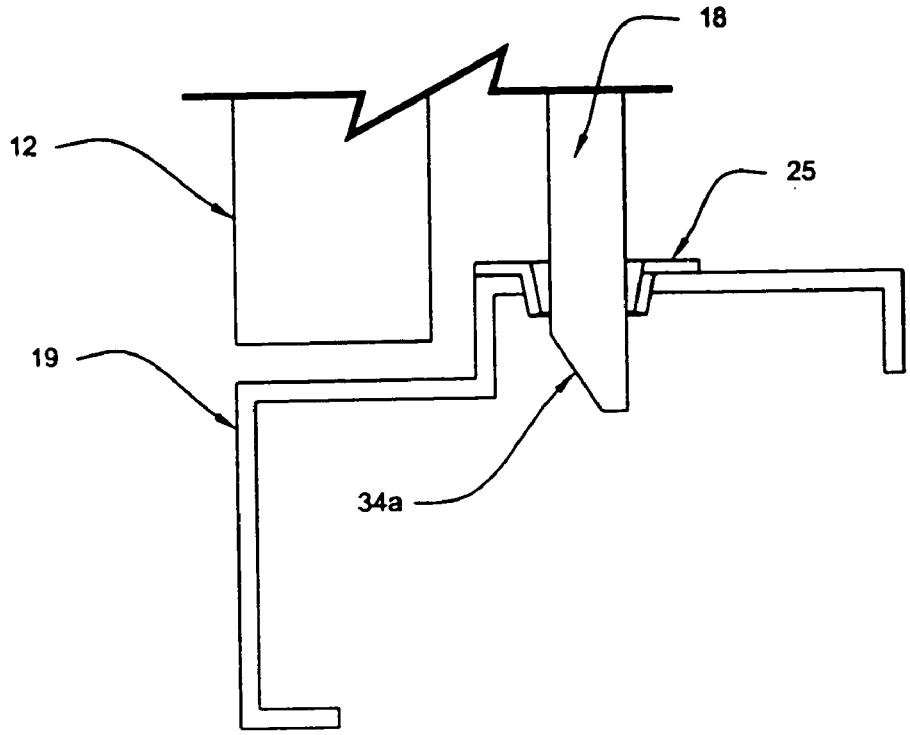
FIG. 11 is a cross sectional view taken along line 11—11 of FIG. 10.

As best seen in FIGS. 10 and 11, as rod 18 moves downwardly, tapered edges 34*a–c* engage the edge of bottom rod receiver 25 and thereby generate a force pulling door 12 inwardly. A gasket 29, usually a rubber gasket, is captured between door 12 and floor 19 and is engaged by the inwardly forced door 12 to provide a tighter seal between door 12 and floor 19. Those skilled in the art will recognize that the same forces act upon the other rod 16, rod receiver 23 and ceiling 17 to provide an all around sealing action.

In addition, preferably, rods 16 and 18 are doubled in thickness at the distal end thereof. The extra thickness provides further security by strengthening an inherent access point where rods 16 and 18 cross the periphery of door 12, i.e. where thieves often employ cutting tools. In the presently preferred embodiment, the rods are comprised of solid square steel bar and the doubling thereof is accomplished by welding two sections of the solid square steel bar together or casting them as a single piece.

Figure 5:
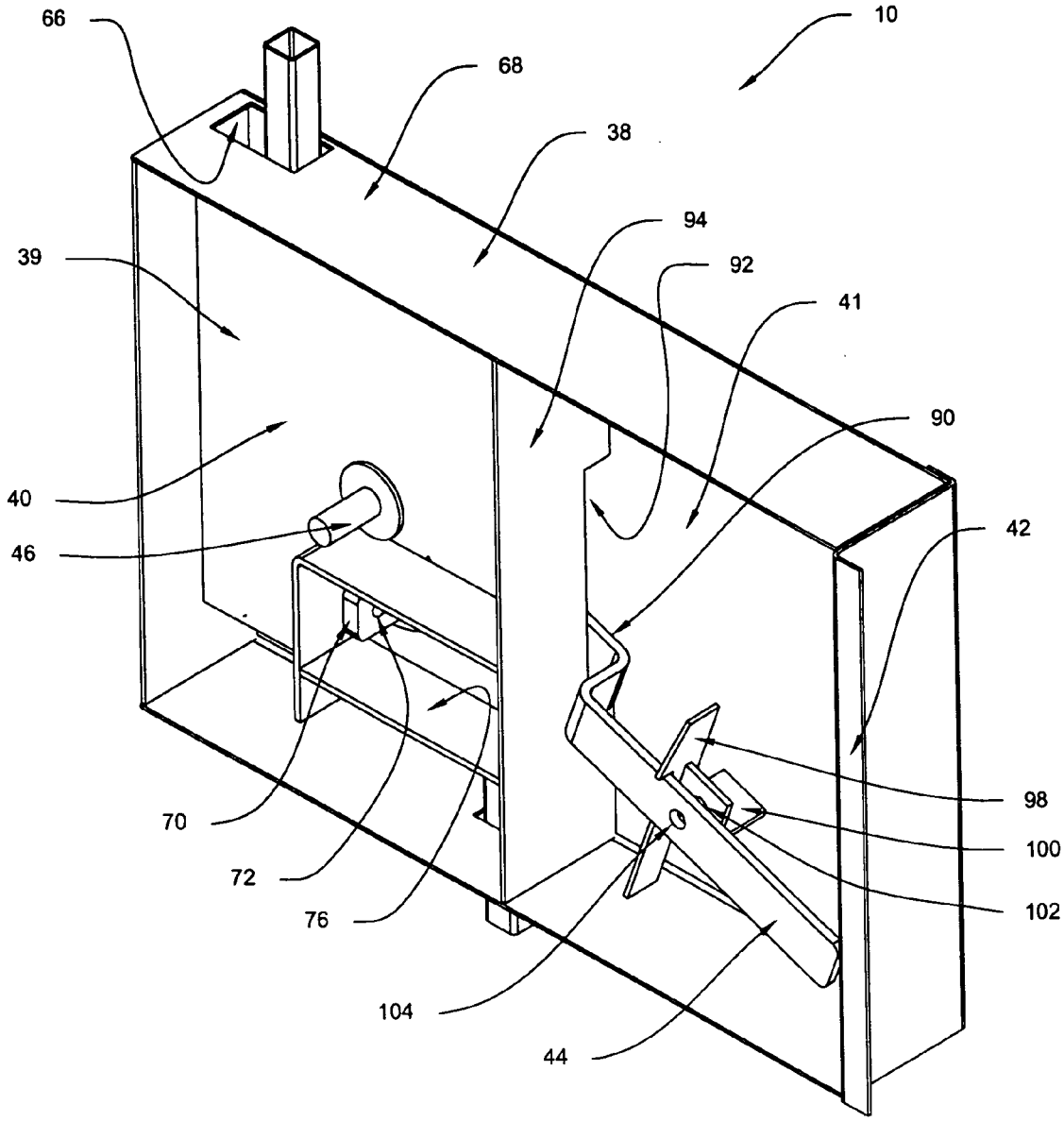
FIG. 5 is a close up perspective view of the present invention.

Turning now to FIGS. 5–8, the operation of locking system 10 is further detailed. As seen in FIG. 5, locking system 10 includes a box like housing 38 divided into a lock section 39 having a front panel 40 and a handle section 41. Housing 38 includes an integral flange 42 extending outwardly from housing 38 which provides for mounting said housing on an opening 9 in door 12. Housing 38 and integral flange 42 are, preferably, made from a heavy gauge metal.

A handle 44 rotatably engages an axle 46. One feature of the present invention is to utilize a relatively long handle 44 to ease the difficulty of locking and unlocking system 10 by maximizing the prying leverage available to a user. In the most preferred embodiment, locking system 10 is positioned on door 12 whereby handle 44 is at a height convenient for users in a normal standing position.

In the illustrated embodiment, handle 44 is a dog leg shape having a hidden portion 90 positioned behind front panel 40 and extending laterally therefrom via a gap 92 in a divider 94 defining the boundary between lock section 39 and handle section 41. An grasping portion 96 of handle 44 is accessed in handle section 41 by a user.

A clip 98 is adapted to engage handle 44 and retain same in a locked position by tension/friction of the steel, but is readily disengaged by a user to rotate handle 44 to the unlocked position. An optional feature is the use of an L-shaped bracket 100 having a lock hole 102 which is positioned to correspond to a lock hole 104 in handle 44 to provide a second locking point.

Another ergonomic feature is that the direction of rotation of handle 44 to close door 12 is, preferably, a downward motion. Such a downward motion affords a user the ability to bear down on handle 44 with their entire body weight to assure engagement of locking rods 16, 18 and 20.

Further, in the presently preferred embodiment, the lock rods 16 and 18 are designed and weighted to fall to the open position thereby preventing doors 12, 13 from accidentally locking a person inside, and further allowing operation of same with a minimum of force.

Lastly, handle 44 is attached to axle 46 using a weak weld whereby excessive force exerted upon handle 44 will cause separation of said handle from axle 46. In the event that axle 46 is damaged or broken, the integrity of locking system 10 is not compromised.

Figure 6:
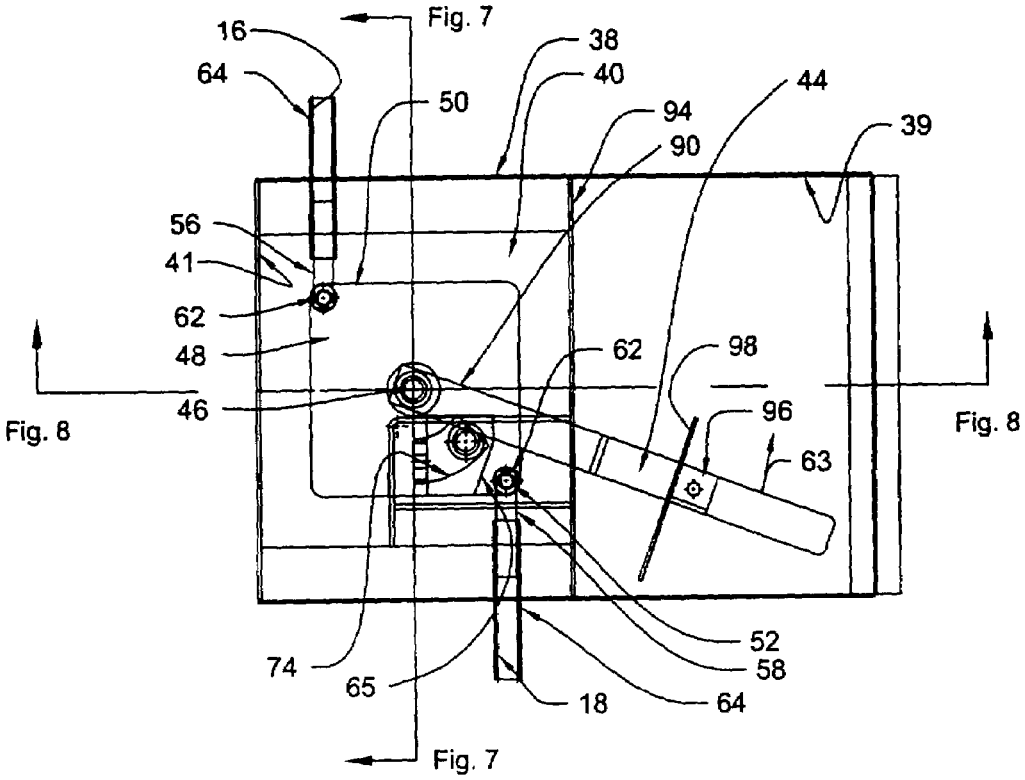
FIG. 6 is cross sectional front view of the embodiment of FIG. 5.
Figure 7:
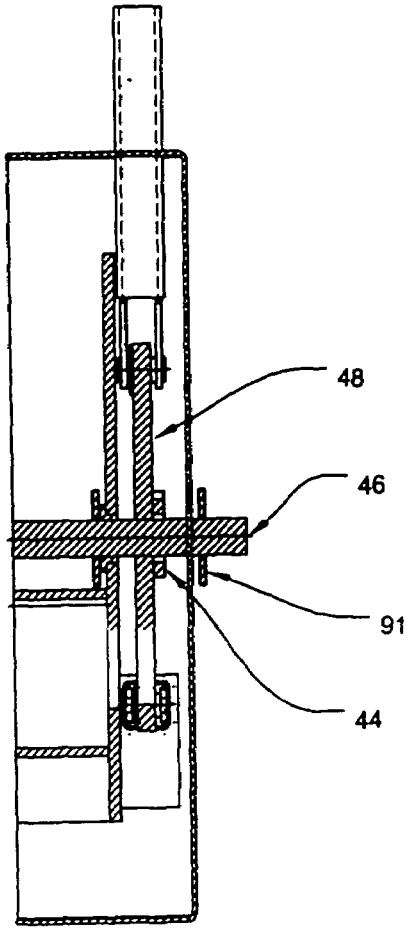
FIG. 7 is a cross sectional view taken along line 7—7 in FIG. 6.
Figure 8:
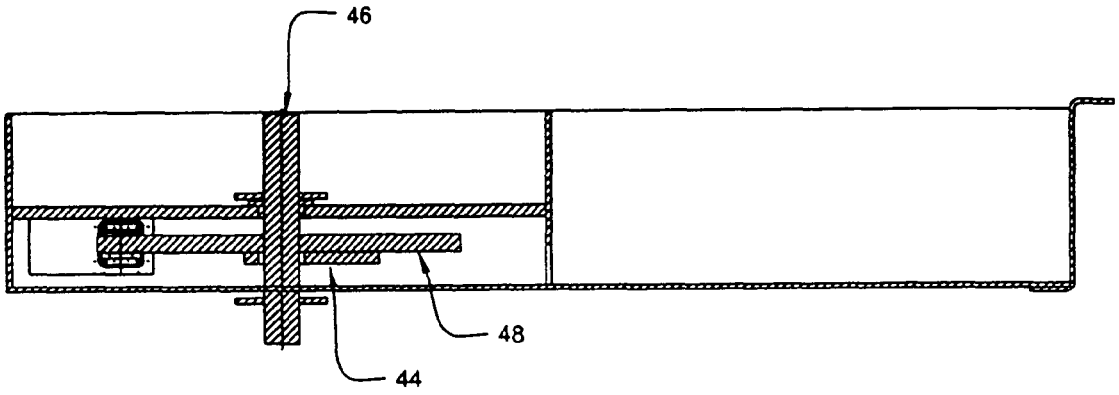
FIG. 8 is a cross sectional view taken along line 8—8 in FIG. 6.
Figure 9:
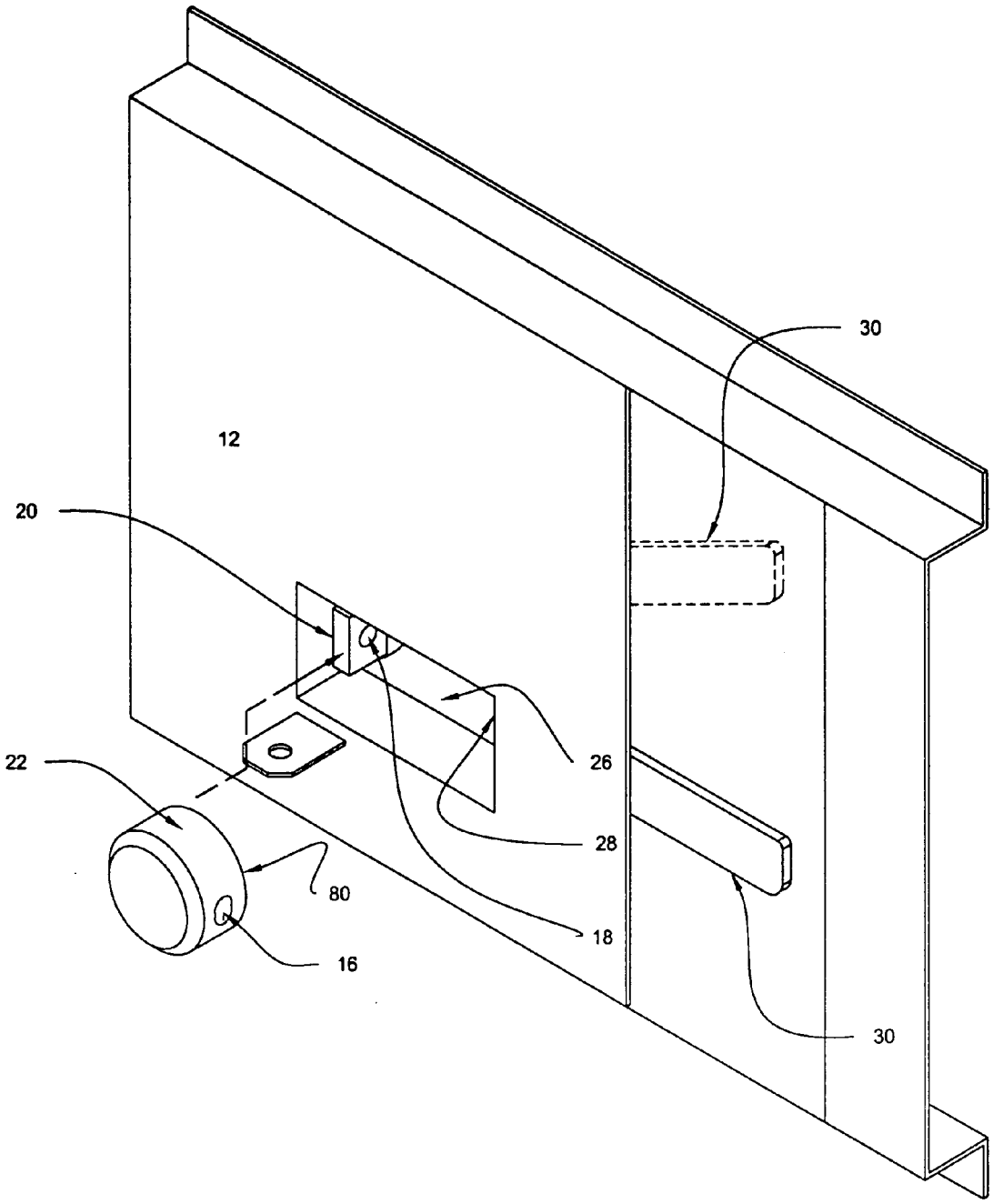
FIG. 9 is a close up perspective view of the present invention showing use of a circular lock therewith.

As best seen in FIG. 6, axle 46 operatively engages a cam plate 48 mounted within lock section 39 of housing 38 which extends laterally therefrom. In the illustrated embodiment, cam plate 48 is square though those skilled in the art will recognize that the particular shape is not important.

At two corners 50, 52 of cam plate 48, a top shaft 56 and a bottom shaft 58, respectively, are mounted, preferably by bushings 62. Each shaft 56 and 58 is mounted to a sleeve or tab 64. Rods 16 and 18 are slidably received within sleeves or tabs 64 corresponding to shafts 56 and 58, respectively. The use of sleeves or tabs 64 permits the user to adjust the length of the rod/sleeve combination to compensate for dimensional variations in storage containers.

Further, cam plate 48 includes anti-torque spacers 65 with maintain cam plate 48 in parallel alignment to housing 38, even if excessive force is applied to cam plate 48 via axle 46 and handle 44. Anti-torque spacers 65 also restrict the entry of outside elements into housing 38.

As best seen in FIG. 5, sleeves/tabs 64 extend through openings 66 in a sidewall 68 of housing 38. In the presently preferred embodiment, sleeves 64 and shafts 56 and 58 are all comprised of square tubing or steel bar and are joined via welding to each other and to rods 16 and 18. Those skilled in the art will recognize the suitability of other materials for the use described herein.

In FIG. 6, locking system 10 is shown in the locked position. To unlock, a user rotates handle 44, and hence cam plate 48 via axle 46, counterclockwise as shown by arrow 61 wherein shafts 56 and 58 are pulled inwardly into housing 38 as shown by arrows 63 thereby retracting rods 16 and 18 via sleeves/tabs 64 to the unlocked position.

A further advantage to locking system 10 is that retraction of rods 16 and 18 into housing 38 affords installation of locking system 10 onto doors 12, 13 through opening 9 which is cut into the front of door 12. Such a construction assists in installation since housing 38 is a one piece installation.

Extending forwardly from cam plate 48 is a single piece, thick locking tab 70 having a lock hole 72 extending therethrough. Tab 70 extends through an arcuate gap 74 into a recess 76 extending outwardly from front plate 40. Tab 70 is mounted to cam plate 48 which is parallel to front plate 40. Tab 70 passes through a slot in cam plate 48, and is welded to both the front and back of cam plate 48. The ends of arcuate gap 74 provide stops which limit the travel of tab 70, and hence cam plate 48, thereby providing the end points for the locked and unlocked positions.

A circular lock 80 engages lock hole 72. Recess 76 is adapted to engage circular lock 80 and thereby prevent movement of tab 70, and hence cam plate 48, when circular lock 80 is engaged with tab 70. Thus, the entire body of circular lock 80 and recess 76 act to prevent movement from the locked position to the unlocked position until circular lock 80 is removed. Thus, movement of cam plate 48 and rods 16 and 18 are not solely dependent upon the structural integrity of tab 70. Recess 76 also provides weather protection for locking system 10.

Although only certain embodiments have been illustrated and described, it will be apparent to those skilled in the art that various changes and modifications may be made therein without departing from the spirit of the invention or from the scope of the appended claims.

What is claimed is:

1. A locking system for use with a storage container, the locking system integral with a door of the cargo storing container, the locking system comprising:

a housing mounted to and extending through a door, two rods extending from the housing, the rods having a locked position extending beyond the periphery of the door and an unlocked position not extending beyond the periphery of the door, each of the two rods having at least one tapered edge on the inside edge extending beyond the periphery of the door in the locked position, two rod receivers, each rod receiver corresponding to one of the two rods, the two rod receivers adapted to receive the tapered edges of the two rods in the locked position, the tapered edges engaging the two rod receivers thereby acting to seal the door tightly in the locked position, a handle recessed behind the housing, the handle engaging a cam plate contained within the housing, the cam plate being operatively engaged with the two rods, the handle rotating the cam plate to move the rods from one of the locked position and the unlocked position to the other of the locked position and the unlocked position, a locking tab extending forwardly from the cam plate into a recess in the housing, the locking tab adapted to be engaged by a circular lock, the locking tab extending through an arcuate gap into the recess, the ends of the arcuate gap providing stops for the locking tab, the stops defining the unlocked position and the locked position, the recess being sized to engage the circular lock and thereby prevent movement of the circular lock and the locking tab when said circular lock is engaged by the locking tab whereby the integrity of the locking system is not dependent upon the integrity of the locking tab.

2. The locking system of claim 1 wherein the locking tab includes a circular lock hole extending therethrough, the hasp of the circular lock extending through the circular lock hole.

3. A locking system for use with a storage container, the locking system being mounted into a door of the cargo storing container, the locking system comprising:

a housing mounted to and extending through a door, a gasket positioned about the periphery of the door, two rods extending from the housing, the rods having a locked position extending beyond the periphery of the door and an unlocked position not extending beyond the periphery of the door, each of the two rods having three tapered edges positioned on the inside and lateral edges of the two rods extending beyond the periphery of the door in the locked position, the three tapered edges engaging the rod receivers to generate a force pulling the door inwardly when in the locked position, two rod receivers, each rod receiver corresponding to one of the two rods, the two rod receivers adapted to receive the tapered edges of the two rods in the locked position, the tapered edges engaging the two rod receivers thereby acting to create a seal using the gasket between the interior and the exterior of the door, a handle recessed behind the housing, the handle engaging a cam plate contained within the housing, the cam plate being operatively engaged with the two rods, the handle rotating the cam plate to move the rods from one of the locked position and the unlocked position to the other of the locked position and the unlocked position, a locking tab extending forwardly from the cam plate into a recess in the housing, the locking tab extending through an arcuate gap into the recess, the ends of the arcuate gap providing stops for the locking tab, the stops defining the unlocked position and the locked position, the locking tab adapted to be engaged by a circular lock, the recess being sized to engage the circular lock and thereby prevent movement of the circular lock and the locking tab when said circular lock is engaged by the locking tab whereby the integrity of the locking system is not dependent upon the integrity of the locking tab.

4. The locking system of claim 3 wherein the locking tab includes a circular lock hole extending therethrough, the hasp of the circular lock extending through the circular lock hole.

5. The locking system of claim 3 wherein the handle rotatably engages an axle recessed behind the housing, the axle engaging the cam plate.

6. The locking system of claim 5 wherein the handle is mounted to the axle by a weld whereby said handle separates from the axle if excessive force is exerted on the handle.

7. The locking system of claim 3 further comprising rod guides mounted proximate to the periphery of the door, the rod guides adapted to align the rods with the rod receivers.

8. The locking system of claim 3 further comprising anti-torque spacers interposed between the cam plate and the housing to maintain the cam plate and the housing in a parallel relationship.

* * * * *